US006060172A

United States Patent [19]

Inoue et al.

[11] Patent Number: 6,060,172

[45] Date of Patent: May 9, 2000

[54] FE-BASED RAPIDLY QUENCHED METAL STRIP

[75] Inventors: Yoshiharu Inoue; Hiroaki Sakamoto, both of Kawasaki, Japan

[73] Assignee: Nippon Steel Corporation, Tokyo, Japan

[21] Appl. No.: 09/058,743

[22] Filed: Apr. 10, 1998

[30] Foreign Application Priority Data

Apr. 11, 1997 [JP] Japan ..... 9-110407

[51] Int. Cl.[7] ..... C22C 45/02

[52] U.S. Cl. ..... 428/551; 148/100; 148/307; 148/320; 148/403; 420/117; 420/121; 428/552; 428/565; 428/900; 428/924; 428/925; 428/928

[58] Field of Search ..... 428/551, 552, 428/565, 900, 924, 925, 928; 148/100, 307, 403, 320; 420/117, 121; 252/62.51

[56] References Cited

U.S. PATENT DOCUMENTS 5,055,144 10/1991 Fish et al. ..... 148/403
5,593,518 1/1997 Ramanan ..... 148/307

*Primary Examiner*—Deborah Jones
*Assistant Examiner*—Robert R. Koehler
*Attorney, Agent, or Firm*—Kenyon & Kenyon

[57] ABSTRACT

The present invention relates to a rapidly quenched metal strip used as a core material for transformers, magnetic shields, choke coils, etc., and to an Fe-based rapidly quenched metal strip having a strip thickness exceeding 20 μm and up to 70 μm, wherein nonmetallic inclusions contained in said metal strip have a maximum particle size up to 50% of the strip thickness, and densities of the nonmetallic inclusions are up to 10 nonmetallic inclusions/mm$^3$ for nonmetallic inclusions having a particle size exceeding 10 μm and up to 50% of the strip thickness, up to $3\times10^3$ nonmetallic inclusions/mm$^3$ for nonmetallic inclusions having a particle size of at least 3 μm to up to 10 μm, and up to $5\times10^5$ nonmetallic inclusions/mm$^3$ for nonmetallic inclusions having a particle size of at least 0.3 μm to less than 3 μm, and showing the following average value $<\epsilon_f>$ of a bending fracture strain $\epsilon_f$, being bent with the free surface of the film strip placed outside:

$$<\epsilon_f>=0.8-1.0$$

and the standard deviation σ of the bending fracture strain $\epsilon_f$ is up to 50% of $<\epsilon_f>$,
wherein $\epsilon_f=t/(D-t)$, t is the strip thickness (mm), and D is the bend diameter of the fractured strip (mm).

10 Claims, 4 Drawing Sheets

×2000

5μm 0.5μm

FE-BASED RAPIDLY QUENCHED METAL STRIP

BACKGROUND OF THE INVENTION

1. Field of the Invention

The present invention relates to a rapidly quenched metal strip for use as a core material for transformers, magnetic shields, choke coils, etc.

2. Description of the Prior Art

A centrifugal rapid quenching process, a single roll process, a twin roll process, and the like process have been known as processes for continuously producing a metal strip by rapidly quenching an alloy from a molten state. These process produce a strip or wire by injecting, from an orifice or the like, a molten metal on the inner or outer periphery of a metal drum, rotating at high speed, to rapidly solidify the molten metal. Moreover, an amorphous alloy similar to a liquid metal can be obtained by properly selecting the alloy composition.

Since amorphous alloys have distinguishing properties, attention has been paid thereto from a practical standpoint. Some of the alloys have already been used in practice. In particular, an Fe-based amorphous alloy has been used as the core material of power transformers and high frequency transformers.

Very pure raw materials have heretofore been used as raw materials for an alloy for producing such a rapidly quenched metal strip. For example, electrolytic iron and ferroboron of high grade have been used as an iron source and a boron source, respectively. The very pure raw materials have been used to avoid adverse effects such as deterioration of magnetic properties caused by impurities contained in raw materials of low grade.

Many studies on the impurities have been reported. For example, Kokai (Japanese Unexamined Patent Publication) No. 57-137451 discloses the maximum allowable contents of impurities in amorphous Fe—Si—B alloy strips. An example of the maximum allowable contents of impurities in an Fe-15.3% B-5.8% Si (by at %) alloy is as follows: 0.14% by weight of Mn, 0.014% by weight of S and 0.005% by weight of P. In order to satisfy the allowable ranges, very pure raw materials must be used. Consequently, the production cost has become high. Several studies have been reported on deterioration of the properties such as magnetic properties and mechanical properties. For example, it has been elucidated that Al contained as an impurity deteriorates the properties because crystallization on the strip surface (e.g., C. Kaido et al.: Rapidly Quenched Metals IV vol. 2 (1981) 957)).

However, the crystallization alone cannot account for the deterioration of the mechanical properties of rapidly quenched metal strips. Even when rapidly quenched metal strips are produced from highly pure raw materials, the following phenomena have often taken place: during casting and coiling a strip, the strip is suddenly fractured; marked variations in mechanical properties, for example, the standard deviation $\sigma$ of bending fracture strain $\epsilon_f$ of a strip exceeds 50% of the average value $<\epsilon_f>$ among lots or depending on sites within a lot. When a strip is used as cores in the production of transformers, the strip is required to be as long as from several meters to several tens of meters. When the strip shows variations in the mechanical properties within a lot, it is very difficult to use only the portion of the strip having excellent mechanical properties while the portion of the strip having poor mechanical properties is removed by cutting. Accordingly, there has been no highly reliable strip showing such decreased variations in the mechanical properties that it shows substantially no fracture during the production of transformers. Moreover, the fracture of the strip lowers its yield in the production of transformers, and causes an increase in the cost.

There has been substantially no report that nonmetallic inclusions exist in rapidly quenched metal strips. Moreover, there has been no report that discloses the influence of the nonmetallic inclusions on the mechanical properties such as a bending strength and the magnetic properties of the strips. There is substantially only one report (H. C. Fiedler et al.: J. Magn. Magn. Mat., 26 (1982) 157) that discloses nonmetallic inclusions in strips. According to the report, crystallization is caused by Al oxides. On the other hand, when the conventional materials were viewed from the standpoint of rapidly quenched metal strips, it was found that there are some strips having a thickness level of, for example, 25 $\mu$m in which the density of nonmetallic inclusions (e.g., oxides mainly containing Fe oxides, or oxides mainly containing Al oxides or Si oxides) present is about $10^7$ nonmetallic inclusions/mm$^3$ and in which the particle size distribution of the nonmetallic inclusions is up to 3 $\mu$m, that is, the proportion of fine nonmetallic inclusions is overwhelmingly large. However, in most of the strips, the proportion of the nonmetallic inclusions and the particle size distribution are in completely random states.

SUMMARY OF THE INVENTION

An object of the present invention is to provide an Fe-based rapidly quenched metal strip having improved mechanical properties and showing decreased variations therein.

A first aspect of the present invention is an Fe-based rapidly quenched metal strip having a thickness exceeding 20 $\mu$m and up to 70 $\mu$m, wherein nonmetallic inclusions contained in said metal strip have a maximum particle size of up to 50% of the strip thickness, and the densities of the nonmetallic inclusions are up to 10 nonmetallic inclusions/mm$^3$ for nonmetallic inclusions having a particle size exceeding 10 $\mu$m and up to 50% of the strip thickness, up to $3\times10^3$ nonmetallic inclusions/mm$^3$ for nonmetallic inclusions having a particle size of at least 3 $\mu$m to up to 10 $\mu$m, and up to $5\times10^5$ nonmetallic inclusions/mm$^3$ for nonmetallic inclusions having a particle size of at least 0.3 $\mu$m to less than 3 $\mu$m, and showing the following average value $<\epsilon_f>$ of a bending fracture strain $\epsilon_f$, being bent with the free surface of the strip placed outside:

$$<\epsilon_f>=0.08-1.0$$

and the standard deviation $\sigma$ of the bending fracture strain $\epsilon_f$ is up to 50% of $<\epsilon_f>$ wherein $\epsilon_f=t/(D-t)$, t is the strip thickness (mm), and D is the bend diameter of the fractured strip (mm).

A second aspect of the present invention is the Fe-based rapidly quenched metal strip, wherein the nonmetallic inclusions contained in said metal strip have a maximum particle size up to 10 μm, the densities of the nonmetallic inclusions are up to $3\times10^3$ nonmetallic inclusions/$mm^3$ for nonmetallic inclusions having a particle size of at least 3 μm to up to 10 μm and up to $5\times10^5$ nonmetallic inclusions/$mm^3$ for nonmetallic inclusions having a particle size of at least 0.3 μm to less than 3 μm, and said metal strip shows the following average value $<\epsilon_f>$ of a bending fracture strain $\epsilon_f$, being bent with the free surface of the strip placed outside:

$$<\epsilon_f>=0.8-1.0$$

and the standard deviation σ of the bending fracture strain $\epsilon_f$ is up to σ of $<\epsilon_f>$
wherein $\epsilon_f=t/(D-t)$, t is the strip thickness (mm), and D is the bend diameter of the fractured strip (mm).

A third aspect of the present invention is an Fe-based rapidly quenched metal strip having a strip thickness of at least 10 μm and up to 20 μm, wherein nonmetallic inclusions contained in said metal strip have a maximum particle size up to 50% of the strip thickness, and the densities of the nonmetallic inclusions are up to $3\times10^3$ nonmetallic inclusions/$mm^3$ for nonmetallic inclusions having a particle size of at least 3 μm to up to 10 μm, and up to $5\times10^5$ nonmetallic inclusions/$mm^3$ for nonmetallic inclusions having a particle size of at least 0.3 μm to less than 3 μm, and showing the following average value $<\epsilon_f>$ of a bending fracture strain $\epsilon_f$, being bent with the free surface of the strip placed outside:

$$<\epsilon_f>=0.8-1.0$$

and the standard deviation σ of the bending fracture strain $\epsilon_f$ is up to 30% of $<\epsilon_f>$
wherein $\epsilon_f=t/(D-t)$, t is the strip thickness (mm), and D is the bend diameter of the fractured strip (mm).

A fourth aspect of the present invention is the Fe-based rapidly quenched metal strip, wherein at least 20% in terms of number of the nonmetallic inclusions per unit volume present in the strip are amorphous oxides containing one or at least two elements selected from the group consisting of Fe, Al, Si, B, Cr, Ni, Mn, Mg, Ca, Cu, Sn and Zr, and said metal strip shows the following average value $<\epsilon_f>$ of a bending fracture strain $\epsilon_f$, being bent with the free surface of the film strip placed outside:

$$<\epsilon_f>=0.8-1.0$$

and the standard deviation σ of the bending fracture strain $\epsilon_f$ is up to 40% of $<\epsilon_f>$.

Furthermore, a fifth aspect of the present invention is the Fe-based rapidly quenched metal strip, wherein at least 20% in terms of number of the nonmetallic inclusions per unit volume present in the strip are amorphous oxides containing one or at least two elements selected from the group consisting of Fe, Al, Si, B, Cr, Ni, Mn, Mg, Ca, Cu, Sn and Zr, and said metal strip shows the following average value $<\epsilon_f>$ of a bending fracture strain $\epsilon_f$, being bent with the free surface of the strip placed outside:

$$<\epsilon_f>=0.8-1.0$$

and the standard deviation σ of the bending fracture strain $\epsilon_f$ is up to 20% of $<\epsilon_f>$.

Furthermore, a sixth aspect of the present invention is the Fe-based rapidly quenched metal strip, wherein at least 20% in terms of number of the nonmetallic inclusions per unit volume present in the strip are amorphous oxides containing one or at least two elements selected from the group consisting of Fe, Al, Si, B, Cr, Ni, Mn, Mg, Ca, Cu, Sn and Zr, and said metal strip shows the following average value $<\epsilon_f>$ of a bending fracture strain $\epsilon_f$, being bent with the free surface of the strip placed outside:

$$<\epsilon_f>=0.8-1.0$$

and the standard deviation σ of the bending fracture strain $\epsilon_f$ is up to 20% of $<\epsilon_f>$.

Furthermore, a seventh aspect of the present invention is an Fe-based rapidly quenched metal strip having a strip thickness of at least 10 μm and up to 70 μm, wherein nonmetallic inclusions contained in said metal strip have a maximum particle size up to 50% of the strip thickness and up to 10 μm, and the densities of the nonmetallic inclusions are up to $1\times10^2$ nonmetallic inclusions/$mm^3$ for nonmetallic inclusions having a particle size of at least 3 μm and up to 10 μm and up to $1\times10^3$ nonmetallic inclusions/$mm^3$ for nonmetallic inclusions having a particle size of at least 0.3 μm to less than 3 μm, and showing, subsequent to annealing, the following average value $<\epsilon_f>$ of a bending fracture strain $\epsilon_f$, being bent with the free surface of the strip placed outside:

$$<\epsilon_f>0.1$$

and the standard deviation σ of the bending fracture strain $\epsilon_f$ is up to 50% of $<\epsilon_f>$
wherein $\epsilon_f=t/(D-t)$, t is the strip thickness (mm), and D is the bend diameter of the fractured strip (mm).

Furthermore, a eighth aspect of the present invention is an Fe-based rapidly quenched metal strip mentioned above, wherein the densities of the nonmetallic inclusions are up to 10 nonmetallic inclusions/$mm^3$ for nonmetallic inclusions having a particle size of at least 3 μm to up to 10 μm and up to $1\times10^2$/$mm^3$ for nonmetallic inclusions having a particle size of at least 0.3 μm to less than 3 μm, and said metal strip shows, subsequent to annealing, the following average value $<\epsilon_f>$ of a bending fracture strain $\epsilon_f$, being bent with the free surface of the strip placed outside:

$$<\epsilon_f>=0.8-1.0$$

and the standard deviation σ of the bending fracture strain $\epsilon_f$ is up to 50% of $<\epsilon_f>$.

Furthermore, a ninth aspect of the present invention is an Fe-based rapidly quenched metal strip, wherein at least 20% in terms of number of the nonmetallic inclusions per unit volume present in the strip are amorphous oxides containing one or at least two elements selected from the group consisting of Fe, Al, Si, B, Cr, Ni, Mn, Mg, Ca, Cu, Sn and Zr, and said metal strip shows subsequently to annealing the following average value $<\epsilon_f>$ of a bending fracture strain $\epsilon_f$, being bent with the free surface of the strip placed outside:

$$<\epsilon_f>0.1$$

and the standard deviation σ of the bending fracture strain $\epsilon_f$ is up to 40% of $<\epsilon_f>$.

Still furthermore, a tenth aspect of the present invention is an Fe-based rapidly quenched metal strip, wherein at least 20% in terms of number of the nonmetallic inclusions per unit volume present in the strip are amorphous oxides containing one or at least two elements selected from the group consisting of Fe, Al, Si, B, Cr, Ni, Mn, Mg, Ca, Cu, Sn and Zr, and said metal strip shows subsequently to annealing the following average value $<\epsilon_f>$ of a bending fracture strain $\epsilon_f$, being bent with the free surface of the strip placed outside:

$$<\epsilon_f>=0.8-1.0$$

and the standard deviation σ of the bending fracture strain $\epsilon_f$ is up to 40% of $<\epsilon_f>$.

BRIEF DESCRIPTION OF THE DRAWINGS

FIG. 2(*b*) shows TEM photographs of inclusions by a diffraction image of a crystalline oxide having an angular shape.

FIG. 3(*b*) shows TEM photographs of inclusions by a diffraction image of an amorphous oxide having a round shape.

FIG. 4(*b*) shows schematic views showing the size of inclusions for an example of gathered inclusions.

DESCRIPTION OF THE PREFERRED EMBODIMENTS

As a result of investigating in detail the relationship between a size and a density of nonmetallic inclusions in strips and mechanical properties to which relationship no one has paid attention, the present inventors have achieved an Fe-based rapidly quenched metal strip of the present invention of which the mechanical properties are improved with the variations therein decreased even when raw materials of low purity are used, by controlling the size and density of the nonmetallic inclusions. Moreover, the present invention provides an Fe-based rapidly quenched metal strip having improved mechanical properties, after annealing, by further strictly controlling the inclusions. The details of achieving the present invention will be explained below. Nonmetallic inclusions are referred to as inclusions hereinafter.

Figure 1:
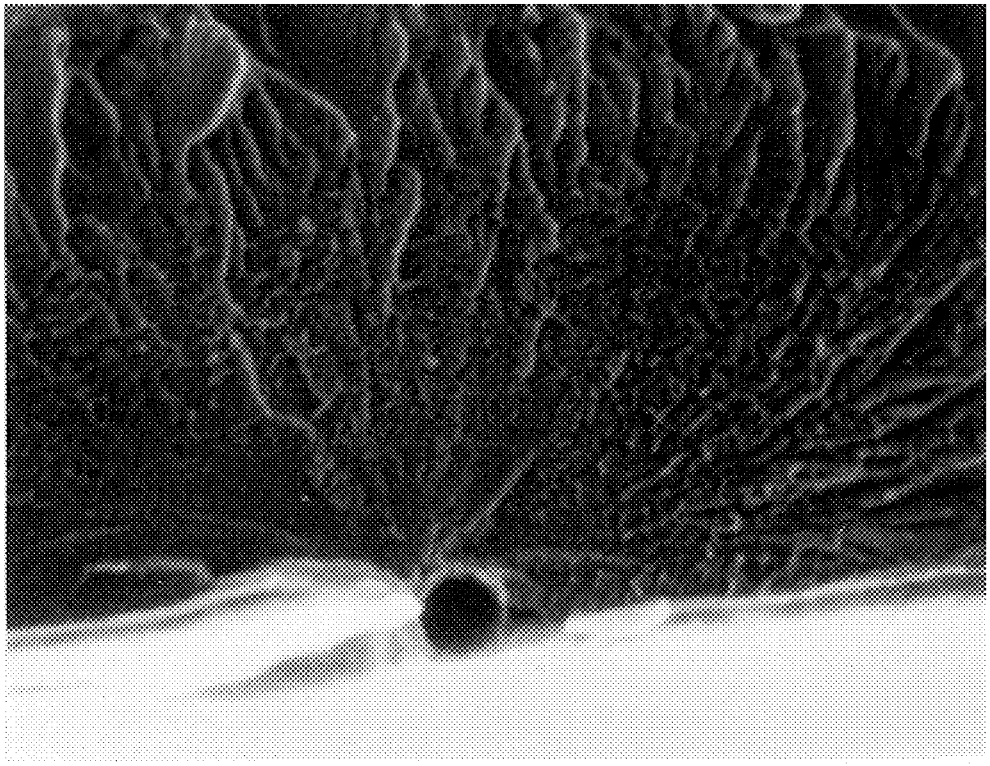
FIG. 1 is a SEM image of the starting point of fracture in a strip.

In the course of preparing an Fe-based rapidly quenched metal strips with various alloy materials and examining the mechanical properties such as a bending strength and magnetic properties, the present inventors have noticed that the measured values of bending strength vary among lots or among sites within a lot. As a result of observing the structure of the strips in detail in the course of examining the cause, the present inventors have found that the size and density of inclusions vary within a lot, depending on the sites. Moreover, as a result of examining the relationship between a size of inclusions near the fracture surface of a bent and fractured strip and a density, the present inventors have elucidated that these values are closely related to a bending strength. In particular, when a strip is fractured, it has been found from the observation of the fracture surface that an inclusion has become the starting point of the fracture. FIG. 1 shows a starting point of fracture caught by observation with a SEM. As a result of elemental analysis of the starting point, the starting point has been found to be an Fe—Si—B—Al oxide. Furthermore, it has been discovered that the variations in the bending strength of a strip are correlated with the size and density of inclusions.

Figure 2A:
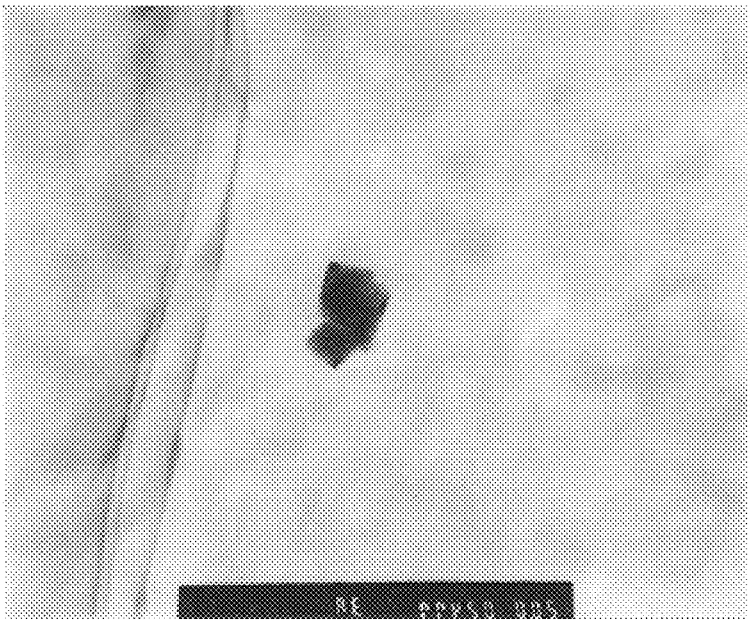
FIG. 2(*a*) shows TEM photographs of inclusions by a bright field image of a crystalline oxide having an angular shape.
Figure 2B:
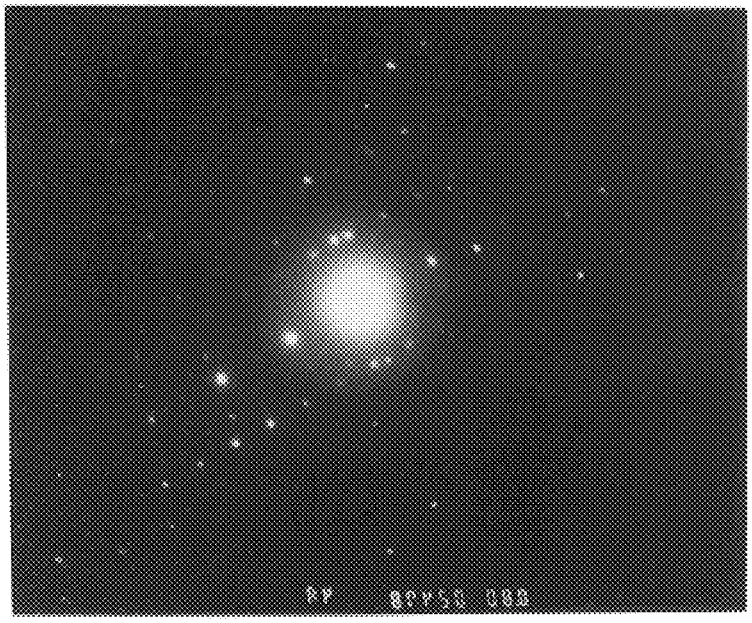
Figure 3A:
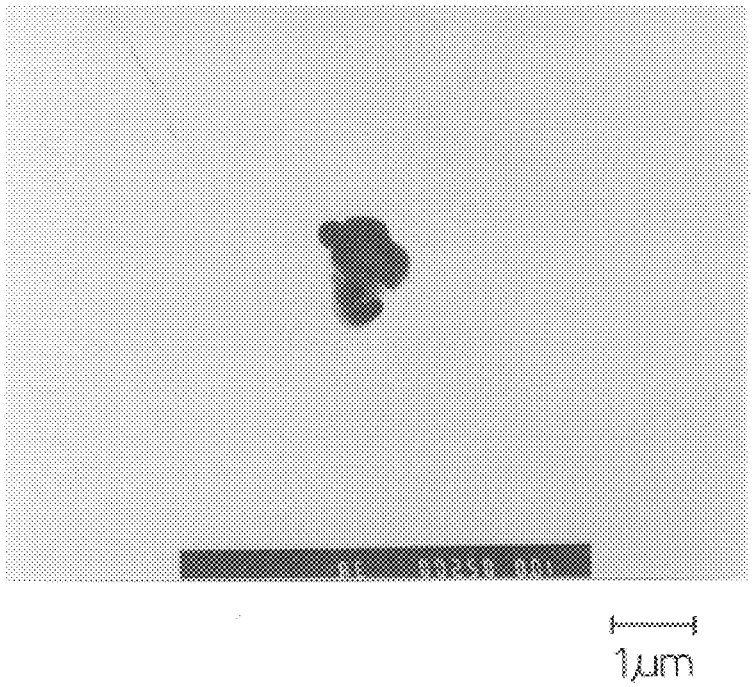
FIG. 3(*a*) shows TEM photographs of inclusions by a bright field image of an amorphous oxide having a round shape.
Figure 3B:
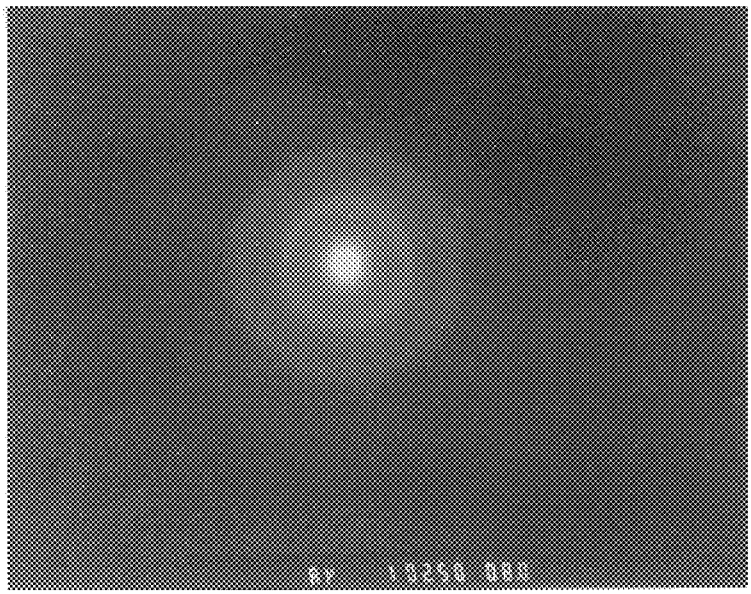

As a result of analyzing inclusions in strips in detail using a transmission electron microscope (TEM), a scanning electron microscope (SEM) and an X-ray microanalyzer (EPMA), etc., the inclusions have been found to be mainly oxides, and contain borides such as $TiB_2$, FeCr carbides, etc. in addition to the oxides. The oxides contain one or at least two elements selected from Fe, Al, Si, B, Cr, Ni, Mn, Mg, Ca, Cu, Sn and Zr. Examples of the principal oxides are oxides such as $Fe_2O_3$ having Fe as their main component, oxides such as $SiO_2$ having Si as their main component and oxides such as $Al_2O_3$ having Al as their main component. Furthermore, it has been found that not only crystalline oxides but also amorphous oxides are contained in the inclusions. The crystalline oxides have been found to contain angular shaped oxides and round shaped oxides in a mixture, whereas most of amorphous oxides have been found to have a round shape. FIG. 2(*a*) and FIG. 2(*b*) shows TEM photographs of an angular crystalline oxide. FIG. 3(*a*) and FIG. 3(*b*) shows TEM photographs of a round amorphous oxide.

The present inventors have analyzed, in the same manner, the inclusions contained in the raw materials including mother alloys prepared from the raw materials by melting, and compared them with inclusions in the strips. As a result, some inclusions in the raw materials have been found to remain in the strips without suffering further processing, and some inclusions therein have been found to be converted into other inclusions as a result of combining with other elements in the molten metals during melting the raw materials, whereby the resultant inclusions have remained in the strips. Both crystalline inclusions and amorphous inclusions have been found in the inclusions having been converted as mentioned above. Since amorphous oxides are not observed in the raw materials, crystalline oxides present in the raw materials are considered to have absorbed other elements in the molten metal (B in particular is an amorphous forming element) to become amorphous. It has become evident from that described above that many inclusions in strips originate from inclusions in the raw materials. In addition to the inclusions originated from the raw materials, inclusions (such as $Al_2O_3$ and MgO) originating from refractories such as crucibles have also been observed.

Since many inclusions originating from the raw materials are present in the strips as explained above, the present inventors have discovered that inclusions therein can be adjusted by controlling the inclusions in the raw materials.

When the inclusions are reduced to almost zero on the basis of the discovery by the present inventors, the mechanical properties of the strips are improved. However, the production cost then rises due to the use of highly pure raw materials and the necessity of providing a complicated purifying step for reducing inclusions; therefore, the procedure is not preferred from the industrial standpoint. The inventors have, therefore, continued the research, and have discovered that a rapidly quenched metal strip excellent in mechanical properties and showing decreased variations in the mechanical properties can be obtained by adjusting the size and density of inclusions in the strip to be within given ranges. The present invention has thus been achieved.

It is the feature of the present invention that the strip of the present invention has such mechanical properties that it can be practically used for the transformers core, etc. even when the strip contains a significant amount of inclusions. According to Griffith's theory of fracture, the fracture strain is determined by the size of an inclusion on the assumption that the inclusion is spherical. A large inclusion becomes the starting point of fracture of a strip even when the strip suffers a small bending strain, and the strip is fractured. That is, when a strip is to suffer a simple bending fracture, the largest inclusion among inclusions present in the region where a simple bending stress is applied becomes the starting point of fracture, and a crack growth takes place, resulting in fracture. Accordingly, in order to improve the mechanical properties of a strip, the size of inclusions must be made as small as possible. As a result of investigating the influence of inclusions on the mechanical properties of a strip, the present inventors have found that the mechanical properties of a strip are greatly influenced not only by the size of inclusions, which has heretofore been said, but also by the density thereof.

Figure 4A:
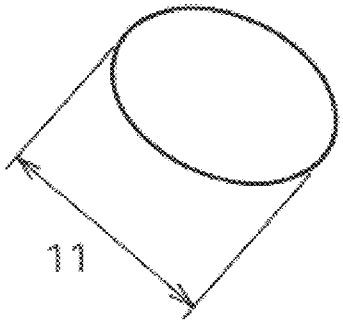
FIG. 4(*a*) shows schematic views showing the size of inclusions for an example of a single inclusion.
Figure 4B:
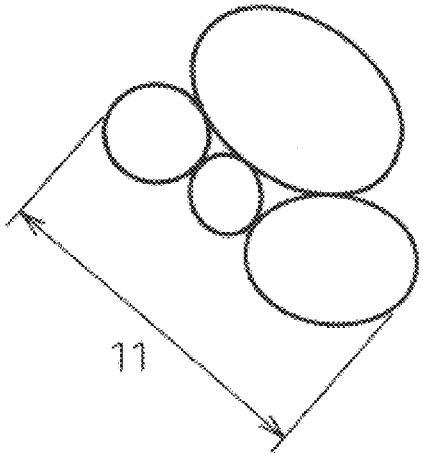

The density of inclusions herein will be expressed by the number of inclusions present per unit volume. When several inclusions are contacted with together, and are considered to be one inclusion in appearance, the gathered inclusions count as one inclusion. Moreover, the size of a inclusion signifies the maximum length of the inclusion when the inclusion is present as a single one, and the maximum length of the gathered inclusions when the inclusions are contacted with each other. The schematic views are shown in FIG. 4(*a*) and FIG. 4(*b*).

In the present invention, as a result of examining inclusions in strips (including strips fractured during casting and coiling) prepared by using raw materials of various grades from low grades to high grades and the mechanical properties, it has been elucidated that the influence of inclusions in the strips on the mechanical properties thereof can be classified into five groups with the size of the inclusions taken as an index.

A first group of the classification is a large inclusion having a particle size exceeding 50% of the strip thickness. Inclusions having a size as mentioned above have been observed in a very small number only in those strips which have been fractured during casting and coiling. Since a strip suffers a tensile stress during casting and coiling, the presence of a large inclusion having a particle size exceeding 50% of the strip thickness is considered to results in fracture of the strip at the site where the inclusion is present.

A second group of inclusions have a particle size exceeding 10 $\mu$m and up to 50% of the strip thickness. The density of such inclusions having a particle size in the range as mentioned above has been as little as up to $10^2/mm_3$. Inclusions having a particle size as mentioned above have been found to become the starting point of fracture of the strip and to cause variations in the mechanical properties. During the examination of the bending strength of strips, strips showing extremely poor properties have been found, and an inclusion present in each of the strips and having a particle size exceeding 10 $\mu$m and up to 50% of the strip thickness has been found to become the starting point of fractures. Since such inclusions having a particle size exceeding 10 $\mu$m and up to 50% of the strip thickness are small in number and are located nonuniformly, the strip shows an extremely low bending strength compared with the average in the region where a bending stress is applied and such an inclusion exists. However, the strip does not show a low bending strength as mentioned above when such an inclusion does not exist in the region. Accordingly, when the density of inclusions having a particle size as mentioned above is high, the variations in mechanical properties of the strip become significant.

A third group of inclusions have a particle size of at least 3 $\mu$m to up to 10 $\mu$m, and their density is up to $10^5/mm^3$. An inclusion having a particle size as mentioned above becomes the starting point of fracture. However, even when a crack is formed, its growth is arrested on the way due to the low density of such inclusions. The formation of such a crack dose not result in fracture of the strip. On the other hand, when the density of inclusions having a particle size as mentioned above is high, a crack formed once propagates via several inclusions, resulting in a final fracture.

A fourth group of inclusion have a particle size of at least 0.3 $\mu$m to less than 3 $\mu$m, and their density is up to $10^8$ nonmetallic inclusions/$mm^3$. An inclusion having a particle size of at least 0.3 $\mu$m to less than 3 $\mu$m seldom becomes the starting point of fracture. Moreover, even when the inclusion becomes the starting point of fracture, the crack is often arrested during its growth, and the crack usually does not result in fracture. However, since the crack tends to grow via inclusions when the density of the inclusions becomes very high, the mechanical properties are deteriorated.

A fifth group of inclusions have a particle size of less than 0.3 $\mu$m. Inclusions having a particle size as mentioned above are not related to the deterioration of the mechanical properties.

It has also become evident that, of the inclusions classified into the five groups, the inclusions having a particle size of at least 3 $\mu$m to up to 10 $\mu$m and the inclusions having a particle size of at least 0.3 $\mu$m to less than 3 $\mu$m are greatly related to the mechanical properties of the strip. That is, it has been found that an inclusion having a particle size of at least 3 $\mu$m to up to 10 $\mu$m becomes the starting point of fracture, and that the growth of the crack is determined by the densities of inclusions having a particle size of at least 3 $\mu$m to up to 10 $\mu$m and inclusions having a particle size of at least 0.3 $\mu$m to less than 3 $\mu$m. When the densities of inclusions having particle sizes as mentioned above are low, the probability of the thus formed crack resulting in fracture becomes low. Conversely, when the densities of inclusions having particle sizes as mentioned above are high, the probability of the thus formed crack resulting in fracture becomes high.

The actual state of inclusions is as described below. Inclusions having a particle size of less than 3 $\mu$m are each often present as isolated ones composed of $Al_2O_3$, $SiO_2$, or the like. Inclusions having a particle size of at least 3 $\mu$m are each often formed from several inclusions which are composed of $Al_2O_3$, $SiO_2$, or the like.

As described above, the amorphous oxides contain one or at least two elements selected from the group consisting of Fe, Si, Al, B, Cr, Ni, Mn, Mg, Ca, Cu, Sn and Zr. The amorphous oxides are mainly oxides having Fe as their principal component, oxides having Si as their principal component or oxides having Al as their principal component. It has been observed that when the proportion of the density of amorphous oxides to that of the total inclusions in the strip become large, the variations in the mechanical properties of the strip tend to become small. The tendency is thought to be manifested by the amorphous oxides having a round shape in contrast to the crystalline oxides having an angular shape. When an angular inclusion suffers a stress, stress concentration takes place at its corner portion, and the inclusion tends to become the starting point of fracture. Accordingly, the variations in the mechanical properties of the strip become small as the proportion of the density of the amorphous oxides in the total inclusions increases.

The reasons for restricting the numerical values of the rapidly quenched metal strip of the present invention will be explained on the basis of the knowledge described above.

The strip thickness of the rapidly quenched metal strip of the present invention is defined to be from at least 10 $\mu$m to up to 70 $\mu$m for the reasons described below. When the strip thickness is less than 10 $\mu$m, a strip having a uniform thickness is difficult to form. When the strip thickness exceeds 70 $\mu$m, casting the strip becomes unstable. The yield of the strip unpreferably lowers when the strip thickness is outside the range defined in the present invention. In the present invention, the particle size of an inclusion is defined as its maximum diameter. The particle size of inclusions contained in the strip is defined to be up to 50% of the strip thickness because the strip containing inclusions having a particle size exceeding 50% of the strip thickness is unpreferably fractured during casting and coiling the strip. In addition, evaluation of the mechanical properties of the strip of the present invention in relation to the strip thickness is defined by a maximum tensile strain $\epsilon_f$ at the time of fracturing the strip in a bending test. The strain is termed a bending fracture strain, and is given by the formula $\epsilon_f = t/(D-t)$ wherein t is the thickness of the strip (mm), and D is the bend diameter (outside diameter: mm). For example, when the bending fracture strain $\epsilon_f$ of a strip having a strip thickness of 60 $\mu$m is up to 0.01, the $\epsilon_f$ value signifies that the strip cannot be coiled around a cylinder having a diameter of 6 mm. When a strip having $\epsilon_f$ as small as mentioned above is used as a transformer core, etc., the radius of curvature in the corner portions is restricted. Moreover, the frequency of fracture of the strip during coiling increases. A small $\epsilon_f$ value, therefore, becomes a disadvantage in using the strip.

In the present invention, a value of $<\epsilon_f>$ is preferably greater than 0.1, because the strip tends to be fractured during processing the strip in the actual production of transformers, etc. when $<\epsilon_f>$ is up to 0.1. The strip having a value of $<\epsilon_f>$ nearly 1 with a complete bending characteristics is more preferable. Because the more increased production yield will be expected during processing in the production of transformers. Moreover, the standard deviation $\sigma$ of $\epsilon_f$ as an index of the variations is preferable up to 50% of the average value $<\epsilon_f>$. This also increases the production yield during processing in the production of transformers. The population of $<\epsilon_f>$ and 94 is determined to be one cast. Moreover, the population can also be determined to be a coil of the strip for one wound core of a transformer.

In as cast strip, the average value of bending fracture strain $<\epsilon_f>$ of 0.8–1.0 and a of up to 50% of $<\epsilon_f>$ can be attained by defining the maximum particle size of nonmetallic inclusions in the strip is up to 50% of the strip thickness, and the density of nonmetallic inclusions having a particle size exceeding 10 $\mu$m and up to 50% of the strip thickness is up to 10 nonmetallic inclusions/$mm^3$, and the density of nonmetallic inclusions having a particle size exceeding 3 $\mu$m and up to 10 is $3\times10^3$ nonmetallic inclusions/$mm^3$, and the density of nonmetallic inclusions having a particle size exceeding 0.3 $\mu$m and less than 3 $\mu$m is $5\times10^5$ nonmetallic inclusions/$mm^3$, when a strip thickness is exceeding 20 $\mu$m and up to 70 $\mu$m.

A creditability of the strip increases a troubles of breakage of the strip during processing in the production of transformers decreases when the range of variations of the value of $<\epsilon_f>$ become smaller. Narrowing the range of variations of the value of $<\epsilon_f>$ can be realized by restricting a number of relatively large nonmetallic inclusions result from the variations. Because the average value of bending fracture strain $<\epsilon_f>$ of 0.8–1.0 and $\sigma$ of up to 30% of $<\epsilon_f>$ can be attained by restricting the maximum particle size of nonmetallic inclusions in the strip is up to 10 $\mu$m, and the density of nonmetallic inclusions having a particle size exceeding 3 $\mu$m and up to 10 $\mu$m is $3\times10^3$ nonmetallic inclusions/$mm^3$m and the density of nonmetallic inclusions having a particle size exceeding 0.3 $\mu$m and less than 3 $\mu$m is $5\times10^5$ nonmetallic inclusions/$mm^3$.

A function of the above described groups of nonmetallic inclusions classified by the size of nonmetallic inclusions is almost same as the strips having a thickness of exceeding 20 $\mu$m and up to 70 $\mu$m, even if the strips thickness getting thinner such as exceeding 10 $\mu$m and up to 20 $\mu$m. However, nonmetallic inclusions existing in the strip having a thickness of 10 $\mu$m and up to 20 gm corresponds to nonmetallic inclusions belonging group 3 to group 5 because 50% of the strip thickness is equal to the particle size of less than 10 $\mu$m, according to the present invention. Accordingly, the average value of bending fracture strain $<\epsilon_f>$ of 0.8–1.0 and a of up to 30% of $<\epsilon_f>$ can be attained by restricting the maximum size of nonmetallic inclusions in the strip is up to 50% of the strip thickness, and the density of nonmetallic inclusions having a particle size exceeding 3 $\mu$m and up to 10 $\mu$m is $3\times10^3$ nonmetallic inclusions/$mm^3$, and the density of nonmetallic inclusions having a particle size exceeding 0.3 $\mu$m and less than 3 $\mu$m is $5\times10^5$ nonmetallic inclusions/$mm^3$.

Narrowing the range of variations of the mechanical properties of the strip can be realized by way of increasing the ratio of density of amorphous oxides within the total nonmetallic inclusions in the strip. In case of the strip having a characteristics having the average value of bending fracture strain $<\epsilon_f>$ of 0.8–1.0 and σ of up to 40% of $<\epsilon_f>$ can be attained by restricting the maximum particle size of nonmetallic inclusions in the strip is up to 50% of the strip thickness, and the density of nonmetallic inclusions having a particle size exceeding 10 μm and up to 50% of the strip thickness is up to 10 nonmetallic inclusions/$mm^3$, and the density of nonmetallic inclusions having a particle size exceeding 3 μm and up to 10 μm is $3\times10^3$ nonmetallic inclusions/$mm^3$, and the density of nonmetallic inclusions having a particle size exceeding 0.3 μm and less than 3 μm is $5\times10^5$ nonmetallic inclusions/$mm^3$, when a strip thickness is exceeding 20 gm and up to 70 μm.

In case of the strip having a characteristics having nonmetallic inclusions in the strip is up to 50% of the strip thickness, and the density of nonmetallic inclusions having a particle size exceeding 10 μm and up to 50% of the strip thickness is up to 10 nonmetallic inclusions/$mm^3$, and the density of nonmetallic inclusions having a particle size exceeding 3 μm and up to 10 μm is $3\times10^3$ nonmetallic inclusions/$mm^3$, and the density of nonmetallic inclusions having a particle size exceeding 0.3 μm and less than 3 μm is $5\times10^5$ nonmetallic inclusions/$mm^3$, when a strip thickness is exceeding 20 μm and up to 70 μm, the average value of bending fracture strain $<\epsilon_f>$ of 0.8–1.0 and σ of up to 40% of $<\epsilon_f>$ can be attained by making at least 20% of in terms of number of nonmetallic inclusions per unit volume present in the strip.

In addition, in case of the strip having a characteristics having the maximum size of nonmetallic inclusions in the strip is up to 10 μm, and the density of nonmetallic inclusions having a particle size exceeding 3 μm and up to 10 μm is $3\times10^3$ nonmetallic inclusions/$mm^3$, and the density of nonmetallic inclusions having a particle size exceeding 0.3 μm and less than 3 μm is $5\times10^5$ nonmetallic inclusions/$mm^3$, when a strip thickness is exceeding 20 μm and up to 70 μm, the average value of bending fracture strain $<\epsilon_f>$ of 0.8–1.0 and σ of up to 20% of $<\epsilon_f>$ can be attained by making at least 20% of in terms of number of nonmetallic inclusions containing amorphous oxides per unit volume present in the strip.

Furthermore, in case of the strip having a characteristics having the maximum size of nonmetallic inclusions in the strip is up to 50% of the strip thickness, and the density of nonmetallic inclusions having a particle size exceeding 3 μm and up to 10 μm is $3\times10^3$ nonmetallic inclusions/$mm^3$, and the density of nonmetallic inclusions having a particle size exceeding 0.3 μm and less than 3 μm is $5\times10^5$ nonmetallic inclusions/$mm^3$, when a strip thickness is exceeding 10 μm and up to 20 μm, the average value of bending fracture strain $<\epsilon_f>$ of 0.8–1.0 and σ of up to 20% of $<\epsilon_f>$ can be attained by making at least 20% of in terms of number of nonmetallic inclusions containing amorphous oxides per unit volume present in the strip.

Such effects of improving the mechanical properties obtained by controlling inclusions in the strip as explained above can be obtained not only from an as cast strip but also from an annealed strip. However, since the Fe-based rapidly quenched metal strip has the disadvantage that it is embrittled even by annealing at temperature up to the crystallization temperature, inclusions in the strip must be controlled more strictly to obtain a strip having improved mechanical properties.

That is, for a strip having a strip thickness of at least 10 μm to up to 70 μm, wherein inclusions contained therein have a maximum particle size up to 50% of the strip thickness and up to 10 μm, and densities of the inclusions are up to $1\times10^2$ nonmetallic inclusions/$mm^3$ for inclusions having a particle size of at least 3 μm to up to 10 μm, and up to $1\times10^3$ nonmetallic inclusions/$mm^3$ for inclusions having a particle size of at least 0.3 μm to less than 3 μm, the strip subsequent to annealing at temperature up to the crystallization temperature shows the following average value $<\epsilon_f>$ of a bending fracture strain $\epsilon_f$, being bent with the free surface of the strip placed outside:

$$<\epsilon_f>=0.1$$

and the standard deviation σ of the bending fracture strain $\epsilon_f$ is up to 50% of $<\epsilon_f>$.

Furthermore, for the strip mentioned above, wherein densities of the inclusions contained therein are up to 50% of the strip thickness and up to 10 nonmetallic inclusions/$mm^3$ for inclusions having a particle size of at least 3 μm to up to 10 μm, and up to $1\times10_2$ nonmetallic inclusions/$mm^3$ for inclusions having a particle size of at least 0.3 μm to less than 3 μm, the strip shows the following average value $<\epsilon_f>$ of a bending fracture strain $\epsilon_f$, being bent with the free surface of the strip placed outside:

$$<\epsilon_f>=0.8-1.0$$

and the standard deviation σ of the bending fracture strain $\epsilon_f$ is up to 50% of $<\epsilon_f>$.

The variations in the mechanical properties a strip can be made small by increasing the proportion of the density of amorphous oxides among the total inclusions in the strip.

For a rapidly quenching metal strip having a strip thickness of at least 10 μm to up to 70 μm, wherein inclusions contained therein have a maximum particle size up to 50% of the strip thickness and up to 10 μm, and densities of the inclusions are up to $1\times10^2$ nonmetallic inclusions/$mm^3$ for inclusions having a particle size of at least 3 μm to up to 10 μm, and up to $1\times10^3$ nonmetallic inclusions/$mm^3$ for inclusions having a particle size of at least 0.3 μm to less than 3 μm, $<\epsilon_f>$ of greater than 0.1 and a of up to 40% of $<\epsilon_f>$ of the strip subsequent to annealing can be attained by making at least 20% in terms of number of the nonmetallic inclusions containing amorphous oxides per unit volume present in the strip.

For a rapidly quenched metal strip having a strip thickness of at least 10 μm to up to 70 μm, wherein inclusions contained therein have a maximum particle size up to 50% of the strip thickness and up to 10 μm, and densities of the inclusions are up to 10 nonmetallic inclusions/$mm^3$ for inclusions having a particle size of at least 3 μm to up to 10 μm, and up to $1\times10^2$ nonmetallic inclusions/$mm^3$ for inclusions having a particle size of at least 0.3 μm to less than 3 μm, the average value $<\epsilon_f>$ of a bending fracture strain $\epsilon_f$, obtained by bending the strip with the free surface of the strip placed outside, of from 0.8 to 1.0 and the standard deviation σ of the bending fracture strain $\epsilon_f$ is up to 40% of $<\epsilon_f>$ can be attained subsequently to annealing the strip by making at least 20% in terms of number of the nonmetallic inclusions containing amorphous oxides per unit volume present in the strip.

The mechanical properties of a strip are considered to be improved by lowering the density of the inclusions. However there is a limitation on lowering the density of inclusions even when available industrial highly pure raw materials are used. In the present invention, it is, therefore, preferred that the lower limit of the density of inclusions present in the strip be defined to be at least 10 nonmetallic inclusions/$mm^3$ for inclusions having a particle size of at least 0.3 $\mu$m to less than 3 $\mu$m, and 1 nonmetallic inclusions/$mm^3$ for inclusions having a particle size of at least 3 $\mu$m to up to 10 $\mu$m.

Although the constituent elements, etc. of the Fe-based alloy rapidly quenched metal strip of the present invention are not particularly restricted, the strip is mainly an Fe—Si—B strip or an Fe—Si—B—C strip. At least 70% by volume of such a rapidly quenched metal strip is amorphous because the strip cannot maintain excellent magnetic and mechanical properties when the content of the amorphous material is up to 70% by volume. An example of an appropriate chemical composition range of the Fe—Si—B—C strip is as follows: at least 70 to up to 86 atomic % of Fe, at least 1 to up to 19 atomic % of Si, at least 7 to up to 20 atomic % of B and at least 0.1 to up to 4 atomic % of C (if C is to be contained). Reasons for providing the appropriate content range of these elements will be explained below.

For example, when the strip is used as a transformer core, the saturated magnetic flux density of the core is determined by the Fe content. A practical level of the saturated magnetic flux density of the core must be as high as at least 1.5 T (tesla). Accordingly, the Fe content for realizing the level must be at least 70 atomic %. On the other hand, when the Fe content exceeds 86 atomic %, formation of the amorphous material becomes difficult, and excellent properties of the strip cannot be obtained. In order to obtain the stabilized magnetic properties and the stabilized production of the strip, it is desirable that the Fe content be at least 77 to up to 83 atomic %. B and Si are added for the purpose of improving the amorphous formability and the thermal stability of the properties. When the B and the Si contents are less than 7 atomic % and less than 1 atomic %, respectively, the amorphous material cannot be formed stably. On the other hand, even when the B and the Si contents are made to exceed 20 atomic % and 19 atomic %, respectively, only a rise in the material cost results, and the improvement of the amorphous formability and the thermal stability cannot be recognized. It is, therefore, preferred that the B content be at least 7 to up to 20 atomic %, and that the Si content be at least 1 to up to 19 atomic %.

Furthermore, C is an element effective in improving the castability of the strip. Addition of C improves the wettability of the molten metal with a cooling substrate, and results in formation of an excellent strip. In view of what is mentioned above, it is preferred that the C content be at least 0.1 to up to 4 atomic %.

In addition to these principal elements, the strip may also contain unavoidable impurities such as Al, Cr, Ni, Mn, Mg, Ca, Cu, Sn and Zr.

Moreover, a strip is annealed for the purpose of relaxing a strain formed during casting, at temperature up to the crystallization temperature. The appropriate ranges of the annealing temperature and the annealing time for the Fe-based rapidly quenched metal strip are from 300 to 400° C. and from 30 minutes to 4 hours, respectively. A preferred annealing atmosphere is a nonoxidizing atmosphere such as a nitrogen atmosphere and an argon atmosphere.

However, the elements and the annealing conditions are restricted to manifest the properties of the strip (such as magnetic properties and mechanical properties) suitable for the transformer core. The subject matter of the present invention is to improve the mechanical properties of the strip by controlling the density of the inclusions. Accordingly, the present invention can also be applied to other Fe-based rapidly quenched metal strips such as an Fe—Ni—Cr—B—C strip which is a highly corrosion-resistant material. In addition to the Fe-based rapidly quenched metal strips, the present invention may also be applied to a Co-based or a Ni-based rapidly quenched metal strip.

Furthermore, although the width of the strip is not specifically restricted in the present invention, a width of at least 0.3 mm is preferred.

The strip of the present invention can be produced by a process wherein alloy raw materials are melted, and the resultant molten metal is injected on a cooling substrate moving at high speed from a slot nozzle, etc. to be solidified rapidly, for example, by a single roll process or a twin roll process.

The most simplified process for controlling a nonmetallic inclusions to obtain the strip is firstly alloy raw materials are melted to obtain a mother alloy for the metal strip, thereafter remelting this mother alloy.

The inclusions can be controlled by the following procedures. For each of the several alloy raw materials such as an iron source and a boron source, there are raw materials of various grades. Accordingly, the particle size and density of the inclusions can be appropriately controlled by using raw materials having selected grades in combination. To take, as an example, an Fe—Si—B—C alloy, the inclusions can be controlled over a wide range by selecting iron sources and boron sources, particularly by selecting the grades of ferroboron which is a boron source.

Melting a mother alloy once is the easiest way to measure an oxygen concentration contained in the mother alloy as an index to control inclusions. The size and density of inclusions are closely related to the particle size and density of inclusions contained in the resultant metal strip, and oxygen has substantially no solubility in iron. Because the principal components of the inclusions are oxides the principal component of the mother alloy is iron, the index to control inclusions can be indicated by the easily measurable oxygen concentration. The optimum range to control the amount of inclusions contained in the metal strip is adjusted by a control of the oxygen concentration in a mother alloy.

When the selected alloy raw materials is melted and the mother alloy is prepared, such melting preferably carried out in a nonoxidizing atmosphere, for example, in a reduced pressure atmosphere, in a vacuum or in an inert gas, with a dense crucible such as a quartz crucible. Accordingly, this operation can be restrained to form the inclusions during melting and effectively control the amount of the inclusions.

Furthermore, the mother alloy is preferably remelted in a nonoxidizing atmosphere, for example, in a reduced pressure atmosphere, in vacuum, in an inert atmosphere, etc., using a dense crucible such as a quartz crucible. Holding the molten metal, obtained by melting the mother alloy by high frequency heating, for a while at a given temperature is effective in controlling inclusions further and improving the mechanical properties. Inclusions are strongly stirred by holding the molten metal, gather together, float, and are removed from the molten metal, whereby the inclusions are decreased. In particular, a decrease in large inclusions is significant. A holding time of less than one minute is not effective. Moreover, casting is not stabilized, sometimes resulting in no formation of the strip. A holding time exceeding one hour unpreferably tends to involve inclusions floating in the molten metal again.

Furthermore, when the molten metal is melted in a nonoxidizing atmosphere and held at a given temperature for a while, oxides which are the main component of the inclusions in the strip are reacted, whereby the oxides become an amorphous material to an increased degree. As a result, the proportion of the density of amorphous oxides to that of inclusions in the strip can be increased. Accordingly, the procedure is effective in improving the mechanical properties of the strip.

A strip is subsequently obtained by a process of injecting the molten metal on a cooling substrate moving at high speed through a slot nozzle, namely a single roll process, a twin roll process, and the like. Single roll apparatuses include a centrifugal rapid quenching apparatus in which a drum inner wall is used, an apparatus in which an endless belt is used, and an apparatus which is an improved type of any of the apparatuses mentioned above and which is equipped with an auxiliary roll and a device for controlling the roll surface temperature.

In addition to these processes, a process including the steps of selecting raw materials having a low oxygen concentration, directly melting the raw materials, and casting the molten metal can also be employed.

Alloy raw materials or a mother alloy prepared from the alloy raw materials by melting are melted, and then inclusions in the molten metal are decreased with a ceramic porous filter which is a filter prepared from CaO, alumina, etc., whereby the particle size and density of inclusions in the strip may be adjusted to appropriate ranges.

The present invention will be explained in more detail with reference to examples.

EXAMPLE 1

A rapidly quenched metal strip having an alloy composition of the formula $Fe_{80.5}Si_{6.5}B_{12}C_1$ in terms of atomic percentage and a width of 25 mm was prepared. Electrolytic iron and a converter steel was used as an iron source of the alloy materials used. Two kinds of ferroboron, namely ferroboron of a high grade and ferroborn of a low grade were used as a boron source. Crystalline Si having a purity of 99.9999% was used as a Si source. Graphite having a purity of 99.99% was used as a C source. Control of the inclusions was conducted by changing the mixing ratio of the two kinds of the iron sources and the two kinds of the boron sources. The index of the mixing ratio is the oxygen concentration. The alloy raw materials was melted in an argon atmosphere using a quartz crucible, and the mother alloy with the same basic components having different oxygen concentration was obtained. The mother alloy thus prepared was remelted in an argon atmosphere using a quartz crucible, and held at the temperature for 5 minutes, and injected from a nozzle on a Cu alloy roll having a diameter of 580 mm and rotated at 700 rpm. The melting temperature was 1,350° C., and the molten mother alloy was in an amount of 1 kg. Double slots having a width of 0.4 mm, a length of 25 mm and a spacing of 1 mm were used as a nozzle. The results are shown in Table 1.

When a strip was obtained, the density of inclusions and the mechanical properties of the as cast strip were evaluated. The size and density of the inclusions were evaluated as follows: the inclusions were exposed on the surface of the strip by way of etching (the SPEED method), and many surface portions were microscopically observed with a SEM and evaluated. The mechanical properties were evaluated by subjecting the as cast strip to a bending test at an angle of 180°. In addition, bending test samples of a lot were sampled at 1 m intervals from the as cast strip, and the number of samples was from 50 to 200.

Furthermore, the ratio of the density of amorphous oxides to that of inclusions in a strip is also shown in Table 1. The ratio was evaluated by transferring inclusions to a carbon film from a microscopically observed face by the replica procedure, and evaluating with a TEM.

The strips No. 2 to No. 8 had no inclusions having a size of exceeding 50% of the strip thickness, and could be coiled without fracture. The strips No. 4 to No. 8 satisfied the mechanical properties of the present invention defined by $<\epsilon_f>$ and σ.

TABLE 1

| Strip No. | Oxygen concn. of mother alloy (ppm) | Strip thickness t (μm) | Density of nonmetallic inclusions (a number of nonmetallic inclusions/mm³) 0.3–3 μm | 3–10 mm | 10-t/2 | Bending fracture strain $<\epsilon_f>$ | $\sigma/<\epsilon_f>$ (%) | Proportion of amorphous oxides (%) | |
|---|---|---|---|---|---|---|---|---|---|
| 1 | 450 | 50 | fractured at an inclusion having a size of at least t/2 (30 μm) | | | | | | C. Ex. |
| 2 | 350 | 50 | $12 \times 10^5$ | $12 \times 10^3$ | 20 | 0.028 | 70 | 10 | C. Ex. |
| 3 | 250 | 50 | $6.4 \times 10^5$ | $5 \times 10^3$ | 10 | 0.65 | 55 | 10 | C. Ex. |
| 4 | 90 | 50 | $4 \times 10^5$ | $2.5 \times 10^3$ | 8 | 0.81 | 38 | 15 | P.I. |
| 5 | 70 | 50 | $3.5 \times 10^5$ | $1.8 \times 10^3$ | 6 | 0.90 | 35 | 20 | P.I. |

TABLE 1-continued

| Strip No. | Oxygen concn. of mother alloy (ppm) | Strip thickness t (μm) | Density of nonmetallic inclusions (a number of nonmetallic inclusions/mm³) 0.3–3 μm | 3–10 mm | 10-t/2 | Bending fracture strain <εf> | σ/<εf> (%) | Proportion of amorphous oxides (%) | |
|---|---|---|---|---|---|---|---|---|---|
| 6 | 60 | 50 | $3.2 \times 10^5$ | $1.2 \times 10^3$ | 3 | 0.95 | 35 | 25 | P.I. |
| 7 | 40 | 50 | $3.0 \times 10^5$ | $9 \times 10^2$ | — | 0.98 | 10 | 35 | P.I. |
| 8 | 30 | 50 | $5.0 \times 10^4$ | $9 \times 10^2$ | — | 1.0 | 0 | 45 | P.I. |

Note: concn. = concentration C. Ex. = Comparative Example, P.I. = Present Invention

EXAMPLE 2

A rapidly quenched metal strip having an alloy composition of the formula $Fe_{80.5}Si_{6.5}B_{12}C_1$ in terms of atomic percentage and a width of 25 mm was prepared. A converter steel was used as an iron source of the alloy raw materials used. Ferroboron of a high grade and ferroboron of a low grade were mixed and used as a boron source. Crystalline Si having a purity of 99.9999% was used as a Si source. Graphite having a purity of 99.99% was used as a C source. The selected raw materials were melted in an argon atmosphere using a quartz crucible. As a result, the mother alloy had an oxygen concentration of 90 ppm. The mother alloy thus prepared was remelted in an argon atmosphere using a quartz crucible, and injected from a nozzle on a Cu alloy roll having a diameter of 580 mm and rotated at 700 rpm. The melting temperature was 1,350° C. The molten mother alloy was in an amount of 1 kg. Double slots having a width of 0.4 mm, a length of 25 mm and a spacing of 1 mm were used as a nozzle. The holding time was varied from 0.5 to 70 minutes in this Example.

When a strip was obtained, the density of inclusions and the mechanical properties of the as cast strip thus obtained were evaluated. The size and density of the inclusions were evaluated as follows: the inclusions were exposed on the surface of the strip by way of etching (the SPEED method), and many surface portions were microscopically observed with a SEM and evaluated. The mechanical properties were evaluated by subjecting the as cast strip to a bending test at an angle of 180°. In addition, bending test samples of a lot were sampled at 1 m intervals from the as cast strip, and the number of the samples was 100. The results are shown in Table 2.

Furthermore, the ratio of the density of amorphous oxides to that of inclusions in a strip is also shown in Table 2. The ratio was evaluated by transferring the inclusions to a carbon film from the microscopically observed face by the replica procedure, and evaluating with a TEM.

When the holding time was 0.5 minute, the strip was not formed. The strips No. 2 to No. 9 gave a strip containing no inclusions having a size of exceeding 50% of the thickness of the strip, and the strip could be coiled without fracture. The strips No. 2 to No. 8 gave a strip satisfied the mechanical properties of the present invention defined by $<\epsilon_f>$ and σ. Furthermore, the strips No. 6 and No. 7 satisfied more preferable mechanical properties.

TABLE 2

| Strip No. | Holding time (min) | Strip thickness t (μm) | Density of nonmetallic inclusions (a number of nonmetallic inclusions/mm³) 0.3–3 μm | 3–10 mm | 10 μm - t/2 | Bending fracture strain <εf> | σ/<εf> (%) | Proportion of amorphous oxides (%) | |
|---|---|---|---|---|---|---|---|---|---|
| 1 | 0.5 | 50 | casting became unstable, and strip was not formed | | | | | | C. Ex. |
| 2 | 2 | 50 | $4.5 \times 10^5$ | $2.5 \times 10^3$ | 8 | 0.81 | 47 | 10 | C. Ex. |
| 3 | 5 | 50 | $4.0 \times 10^5$ | $1 \times 10^3$ | 8 | 0.81 | 42 | 15 | P.I. |
| 4 | 10 | 50 | $3.0 \times 10^5$ | $1 \times 10^3$ | 4 | 0.87 | 35 | 30 | P.I. |
| 5 | 20 | 50 | $2.0 \times 10^5$ | $1.0 \times 10^3$ | 4 | 0.91 | 30 | 35 | P.I. |
| 6 | 30 | 50 | $0.9 \times 10^3$ | $0.9 \times 10^2$ | — | 0.97 | 17 | 50 | P.I. |
| 7 | 40 | 50 | $0.7 \times 10^3$ | $0.8 \times 10^2$ | — | 1.0 | 0 | 60 | P.I. |
| 8 | 60 | 50 | $0.5 \times 10^5$ | $2.0 \times 10^3$ | 5 | 0.82 | 55 | 60 | P.I. |
| 9 | 70 | 50 | $0.3 \times 10^5$ | $4.0 \times 10^3$ | 15 | 0.5 | 55 | 65 | C. Ex. |

Note: C. Ex. = Comparative Example, P.I. = Present Invention

EXAMPLE 3

Rapidly quenched metal strips having an alloy composition of the formula $Fe_{80.5}Si_{6.5}B_{12}C_1$ in terms of atomic percentage and a width of 25 mm were prepared. Electrolytic iron and a converter steel were used as an iron source of the alloy materials used. Two kinds of ferroboron, namely ferroboron of a high grade and ferroborn of a low grade were used as a boron source. Crystalline Si having a purity of 99.9999% was used as a Si source. Graphite having a purity of 99.99% was used as a C source. Control of the inclusions was conducted by changing the mixing ratio of the two kinds of the iron sources and the two kinds of the boron sources. The raw materials were melted in an argon atmosphere using a quartz crucible, and mother alloys were prepared therefrom by melting. The using a mother alloys thus prepared were remelted in an argon atmosphere using a quartz crucible, and the molten alloys were each injected from a nozzle on a Cu alloy roll having a diameter of 580 mm and rotated at 700 rpm. The melting temperature was 1,350° C., and the holding time was 30 minutes. The molten mother alloys were each in an amount of 1 kg. The apparatus used was the same as in Example 1. A single slot having a width of 0.4 mm and length of 25 mm, double slots and triple slots having a width of 0.4 mm, a length of 25 mm and a spacing of 1 mm were used, and varied a strip thickness in this Example.

The density of inclusions and the mechanical properties of the as cast strips thus obtained were evaluated. The size and density of the inclusions were evaluated as follows: the inclusions were exposed on the surface of the strip by way of etching (the SPEED method), and many surface portions were microscopically observed with a SEM and evaluated. The mechanical properties were evaluated by subjecting the as cast strips to a bending test at an angle of 180°. In addition, bending test samples of a lot were sampled at 1 m intervals from the as cast strip, and the number of samples was from 50 to 200. The results are shown in Table 3.

Furthermore, the ratio of the density of amorphous oxides to that of inclusions in a strip is also shown in Table 3 (strips No. 9 to No. 11 being excluded). The ratio was evaluated by transferring inclusions to a carbon film from the microscopically observed face by the replica method, and evaluating with a TEM.

Since the strips No. 1 to No. 11 evaluated in the present example had no inclusions having a size exceeding 50% of the strip thickness, they could be coiled without fracture. Of the strips, the strips No. 3 to No. 8 were subjected to the control of the density of inclusions. Accordingly, they satisfied the mechanical properties of the present invention defined by $<\epsilon_f>$ and $\sigma$ in the present invention over the entire length of the strips ranging from several tens of meters to several hundred meters.

Furthermore, the strips No. 9 to No. 11 were strips of different lots prepared under the same conditions of No. 4. There was no substantial difference in the mechanical properties of the strips among the lots. The conventional strips prepared even from highly pure materials have often shown marked variations in mechanical properties among lots, for example, the standard deviation $\sigma$ of the bending fracture strain $\epsilon_f$ among lots exceeds 50% of the average value $<\epsilon_f>$. Compared with the results of the production of the conventional strips, those mentioned above in the present example show that strips showing decreased variations in mechanical properties can be stably prepared by defining the inclusions.

Figure 5:
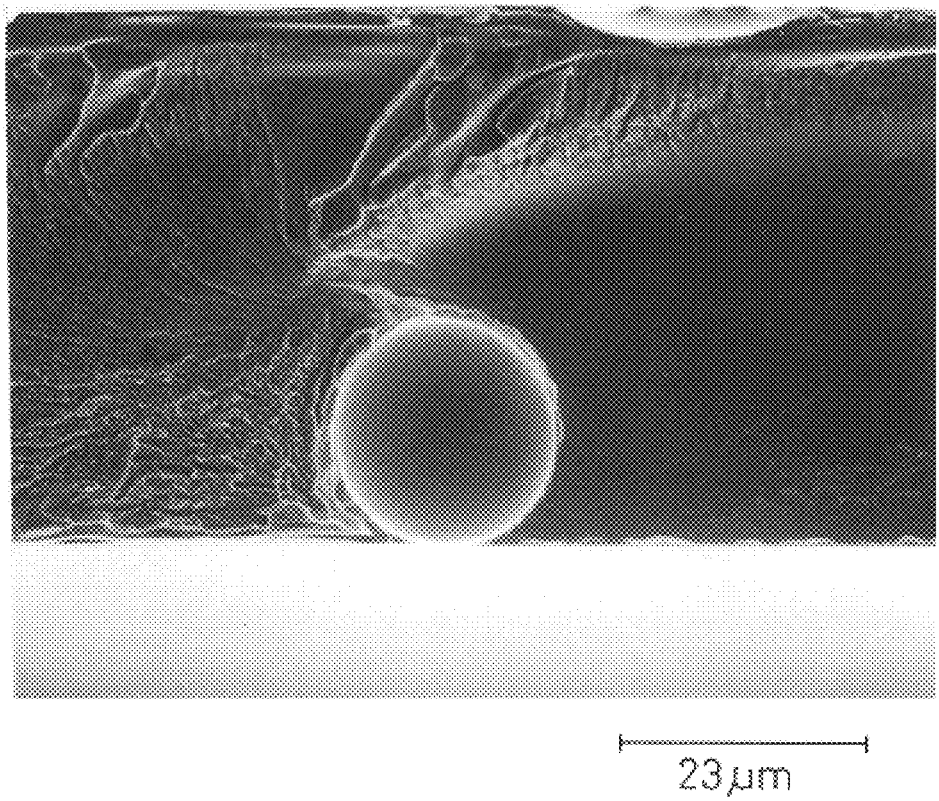
FIG. 5 is a SEM image of a fracture surface subsequent to bending fracture in a strip No. 1 (Example 3).

FIG. 5 shows a SEM image of the fracture surface of the strip No. 1 in Table 3 subsequent to bending fracture. A gap having a diameter of about 17 $\mu$m was observed at the portion on the fracture surface from which the fracture seemed to have started. An inclusion having a size of 17 $\mu$m is considered to have existed in the gap. The bending fracture strain $\epsilon_f$ of the fractured site of the strip was 0.008. The value was a very poor one, compared with the average value $<\epsilon_f>$ of the strip of 0.028. The strip shows a deteriorated mechanical properties at a site where an inclusion having a size exceeding 10 $\mu$m is present. As a result, the site where the inclusion is present shows a low stress at which fracture starts compared with the sites around the above-mentioned one. The phenomenon causes the marked variations in the mechanical properties of the strip, namely a $\sigma/<\epsilon_f>$ ratio of 70(%).

TABLE 3

| Strip No. | Holding time (min) | Strip thickness t ($\mu$m) | Density of nonmetallic inclusions (a number of nonmetallic inclusions/mm$^3$) 0.3–3 $\mu$m | 3–10 mm | 10 $\mu$m - t/2 | Bending fracture strain $<\epsilon_f>$ | $\sigma/<\epsilon_f>$ (%) | Proportion of amorphous oxides (%) | |
|---|---|---|---|---|---|---|---|---|---|
| 1 | 350 | 50 | $1.2 \times 10^6$ | $1.2 \times 10^4$ | 20 | 0.028 | 70 | 8 | C. Ex. |
| 2 | 150 | 50 | $60 \times 10^4$ | $3.0 \times 10^3$ | — | 0.62 | 10 | 30 | C. Ex. |
| 3 | 90 | 25 | $35 \times 10^4$ | $2.5 \times 10^3$ | 8 | 0.92 | 38 | 35 | P.I. |
| 4 | 85 | 50 | $30 \times 10^4$ | $2 \times 10^3$ | 5 | 0.90 | 37 | 40 | P.I. |
| 5 | 75 | 65 | $21 \times 10^4$ | $2 \times 10^3$ | 8 | 0.82 | 35 | 30 | P.I. |
| 6 | 30 | 25 | $9 \times 10^4$ | $1.0 \times 10^3$ | — | 1.0 | 0 | 60 | P.I. |
| 7 | 35 | 50 | $18 \times 10^4$ | $1.5 \times 10^3$ | — | 0.97 | 17 | 50 | P.I. |
| 8 | 30 | 65 | $20 \times 10^4$ | $1.2 \times 10^3$ | — | 0.90 | 19 | 55 | P.I. |
| 9 | 85 | 50 | $31 \times 10^4$ | $2.1 \times 10^3$ | 5 | 0.91 | 37 | | P.I. |
| 10 | 85 | 50 | $30 \times 10^4$ | $1.9 \times 10^3$ | 6 | 0.89 | 36 | | P.I. |
| 11 | 85 | 50 | $29 \times 10^4$ | $2.0 \times 10^3$ | 6 | 0.92 | 38 | | P.I. |

Note: concn. = concentration C. Ex. = Comparative Example, P.I. = Present Invention

EXAMPLE 4

Strips having different compositions were prepared by melting various alloy raw materials using the same apparatus as in Example 1. Electrolytic iron and a converter steel were used as an iron source of the alloy raw materials used. Two kinds of ferroboron, namely ferroboron of a high grade and ferroborn of a low grade were used as a boron source. Control of the inclusions was conducted by changing the mixing ratio of the two kinds of the iron sources and the two kinds of the boron sources. The raw materials were treated and melted in the same manner as in Example 1. Mother alloys were prepared by melting in an argon atmosphere using a quartz crucible. They were remelted, and cast. The strips thus obtained had a width of 120 mm. The melting temperature was 1,350° C., and the holding time was 30 minutes. The molten mother alloys were each in an amount of 5 kg. A single slot, double slots and triple slots were used for the nozzle, and the strip thickness was varied.

The density of inclusions and the mechanical properties of the as cast strips thus obtained were evaluated. Moreover, the ratio of the density of amorphous oxides to that of inclusions in a strip was also evaluated. The evaluation procedure was the same as in Example 1. The test pieces were sampled from a lot of a strip at 5 m intervals. Table 4 shows the results thus obtained.

Since no inclusions having a size exceeding 50% of the strip thickness were found in the strips No. 1 to No. 14 evaluated this time, the strips could be coiled without fracture. Moreover, of the strips, the strips No. 1 to No. 12 were subjected to the strict control of the density of inclusions. Consequently, the strips satisfied the mechanical properties of the present invention defined by $<\epsilon_f>$ and $\sigma$ over the entire length of the strips ranging from several tens of meters to several hundred meters.

TABLE 4

| Strip No. | Oxygen concn. of mother alloy (ppm) | Composition (atomic %) | t+ μm | Density of nonmetallic inclusions (a number of nonmetallic inclusions/mm³) 0.3–3 μm | 3–10 μm | 10 μm-t/2 | Bending fracture strain $<\epsilon_f>$ | $\sigma/<\epsilon_f>$ (%) | Proportion of amorphous oxides (%) |
|---|---|---|---|---|---|---|---|---|---|
| 1* | 90 | $Fe_{78}Si_{12}B_{10}$ | 25 | $33 \times 10^4$ | $2.0 \times 10^3$ | 7 | 0.93 | 36 | 35 |
| 2* | 90 | $Fe_{78}Si_{12}B_{10}$ | 50 | $32 \times 10^4$ | $2.5 \times 10^3$ | 6 | 0.90 | 35 | 40 |
| 3* | 90 | $Fe_{78}Si_{12}B_{10}$ | 65 | $21 \times 10^4$ | $2.2 \times 10^3$ | 8 | 0.81 | 36 | 30 |
| 4* | 30 | $Fe_{78}Si_{12}B_{10}$ | 25 | $10 \times 10^4$ | $1.0 \times 10^3$ | — | 1.0 | 0 | 60 |
| 5* | 30 | $Fe_{78}Si_{12}B_{10}$ | 50 | $16 \times 10^4$ | $13 \times 10^3$ | — | 0.97 | 15 | 50 |
| 6* | 30 | $Fe_{78}Si_{12}B_{10}$ | 65 | $18 \times 10^4$ | $1.4 \times 10^3$ | — | 0.90 | 17 | 55 |
| 7* | 85 | $Fe_{80.5}Si_{2.5}B_{16}C_1$ | 25 | $37 \times 10^4$ | $2.5 \times 10^3$ | 6 | 0.92 | 37 | 35 |
| 8* | 85 | $Fe_{80.5}Si_{2.5}B_{16}C_1$ | 50 | $35 \times 10^4$ | $1.8 \times 10^3$ | 6 | 0.90 | 36 | 40 |
| 9* | 85 | $Fe_{80.5}Si_{2.5}B_{16}C_1$ | 65 | $25 \times 10^4$ | $2.2 \times 10^3$ | 8 | 0.82 | 38 | 35 |
| 10* | 35 | $Fe_{80.5}Si_{2.5}B_{16}C_1$ | 25 | $9 \times 10^4$ | $1.0 \times 10^3$ | — | 1.0 | 0 | 65 |
| 11* | 35 | $Fe_{80.5}Si_{2.5}B_{16}C_1$ | 50 | $18 \times 10^4$ | $1.5 \times 10^3$ | — | 0.97 | 14 | 50 |
| 12* | 35 | $Fe_{80.5}Si_{2.5}B_{16}C_1$ | 65 | $20 \times 10^4$ | $1.2 \times 10^3$ | — | 0.90 | 19 | 50 |
| 13# | 380 | $Fe_{78}Si_{12}B_{10}$ | 50 | $130 \times 10^4$ | $15 \times 10^3$ | 12 | 0.04 | 60 | 10 |
| 14# | 370 | $Fe_{80.5}Si_{2.5}B_{16}C_1$ | 50 | $120 \times 10^4$ | $12 \times 10^3$ | 20 | 0.02 | 65 | 20 |

Note: concn. = concentration * designating Present Invention, # designating Comparative Example +: t designating a strip thickness,

EXAMPLE 5

Rapidly quenched metal strips having a thickness of 10 to 20 μm were prepared using the same apparatus as in Example 1. The width was 25 mm. Control of the inclusions was conducted in the same manner as in Example 1. The melting temperature was 1,350° C., and the holding time was 30 minutes. The mother alloys were melted each in an amount of 1 kg. The molten alloy materials were each injected from a nozzle on a Cu alloy roll having a diameter of 580 mm and rotated at 700 rpm. The nozzle used was a single slot having a width of 0.4 mm and a length of 25 mm. The strips thus produced had an alloy composition of the formula $Fe_{80.5}Si_{6.5}B_{12}C_1$ in terms of atomic percentage.

The density of inclusions and the mechanical properties of the as cast strips thus obtained were evaluated. Moreover, the ratio of the density of amorphous oxides to that of inclusions in a strip was also evaluated. The evaluation procedures were the same as in Example 2. The bending test samples were sampled from the lot of the strip at 1 m intervals. Table 5 shows the results thus obtained.

Since no inclusions having a size exceeding 50% of the strip thickness were found in the strips No. 1 to No. 4 evaluated this time, the strips could be coiled without fracture. Of the strips, the strips No. 1 to No. 3 were those satisfying the mechanical properties of the present invention defined by $<\epsilon_f>$ and $\sigma$ over the entire length from several tens of meters to several hundred meters.

TABLE 5

| Strip No. | Oxygen concn. of mother alloy (ppm) | Strip thickness t (μm) | Density of nonmetallic inclusions (a number of nonmetallic inclusions/mm³) 0.3–3 μm | 3–10 μm | Bending fracture strain $<\epsilon_f>$ | $\sigma/<\epsilon_f>$ (%) | Proportion of amorphous oxides (%) | |
|---|---|---|---|---|---|---|---|---|
| 1 | 45 | 12 | $8 \times 10^4$ | $1.5 \times 10^3$ | 1.0 | 0 | 60 | P.I. |
| 2 | 35 | 15 | $5 \times 10^4$ | $1.0 \times 10^3$ | 1.0 | 0 | 55 | P.I. |

TABLE 5-continued

| Strip No. | Oxygen concn. of mother alloy (ppm) | Strip thickness t (μm) | Density of nonmetallic inclusions (a number of nonmetallic inclusions/mm³) 0.3–3 μm | 3–10 μm | Bending fracture strain $<\epsilon_f>$ | $\sigma/<\epsilon_f>$ (%) | Proportion of amorphous oxides (%) | |
|---|---|---|---|---|---|---|---|---|
| 3 | 45 | 18 | $9 \times 10^4$ | $2.5 \times 10^3$ | 0.98 | 20 | 50 | P.I. |
| 4 | 320 | 15 | $12 \times 10^5$ | $12 \times 10^3$ | 0.029 | 70 | 15 | C. Ex. |

Note: concn. = concentration P.I. = Present Invention, C. Ex. = Comparative Example

EXAMPLE 6

This example exhibits a evaluation of the mechanical properties of the annealed strip.

A rapidly quenched metal strip having a width of 25 mm was prepared using the same apparatus as in Example 1. The strip thus produced had an alloy composition of the formula $Fe_{80.5}Si_{6.5}B_{12}C_1$ in terms of atomic percentage. Of alloy raw materials used, the iron source:high purity iron having a purity of 99.99% and electrolytic iron, and the boron source-:high purity boron having a purity of 99.99%. The other raw materials were the same as in Example 1. The mother alloys were prepared by melting, in the same manner as in Example 1. The mother alloys thus prepared were remelted, and the molten alloys were each injected from a nozzle on a Cu alloy roll having a diameter of 580 mm and rotated at 700 rpm. The melting temperature was 1,350° C., and the holding time was 30 minutes. The molten mother alloys were each in an amount of 1 kg. A single slot having a width of 0.4 mm and length of 25 mm, double slots and triple slots were used for the nozzle.

The strips thus obtained were annealed in a nitrogen atmosphere at 360° C. for 1 hour, and the density of inclusions in the strips and the mechanical properties thereof were evaluated. The evaluation procedures were the same as in Example 1. Bending test samples of a lot were sampled at 1 m intervals from the strip. The results are shown in Table 6. Furthermore, Table 6 also shows the ratio of the density of amorphous oxides to that of inclusions in a strip. The evaluation procedure was the same as in Example 1.

Since the strips No. 1 to No. 7 evaluated in the present example had no inclusions having a size exceeding 50% of the strip thickness and exceeding 10 μm, they could be coiled without fracture. The strict control of the density of inclusions is achieved therefore, and, the strips subsequent to annealing satisfied the mechanical properties of the present invention defined by $<\epsilon_f>$ and σ over the entire length of the strips ranging from several tens of meters to several hundred meters.

TABLE 6

| Strip No. | Oxygen concn. of mother alloy (ppm) | Strip thickness t (μm) | Density of nonmetallic inclusions (a number of nonmetallic inclusions/mm³) 0.3–3 μm | 3–10 μm | Bending fracture strain $<\epsilon_f>$ | $\sigma/<\epsilon_f>$ (%) | Proportion of amorphous oxides (%) | |
|---|---|---|---|---|---|---|---|---|
| 1 | 18 | 25 | 700 | 80 | 0.2 | 46 | 55 | P.I. |
| 2 | 19 | 25 | 200 | 30 | 0.4 | 20 | 60 | P.I. |
| 3 | 5 | 25 | 80 | 8 | 0.9 | 5 | 65 | P.I. |
| 4 | 15 | 60 | 600 | 80 | 0.2 | 40 | 55 | P.I. |
| 5 | 3 | 60 | 30 | 2 | 0.8 | 10 | 60 | P.I. |
| 6 | 15 | 15 | 700 | 90 | 0.2 | 30 | 50 | P.I. |
| 7 | 3 | 15 | 40 | 2 | 1.0 | 0 | 70 | P.I. |

Note: concn. = concentration P.I. = Present Invention

EXAMPLE 7

A rapidly quenched metal strip having an alloy composition of the formula $Fe_{60}B_{12}C_4Ni_{20}Cr_4$ in terms of atomic percentage and thickness of 25 μm and width of 0.6 mm was prepared. Electrolytic iron and a converter steel was used as an iron source of the alloy materials used. Two kinds of ferroboron, namely ferroboron of a high grade and ferroboron of a low grade were used as a boron source. Graphite having a purity of 99.99% was used as a C source. Metallic Ni having a purity of 99.99% was used as a Ni source. Metallic Cr having a purity of 99.99% was used as a Cr source. Control of the inclusions was conducted by changing the mixing ratio of the two kinds of the iron sources and two kinds of the boron sources. The alloy materials were melted in an argon atmosphere using a quartz crucible, and obtained the mother alloy. The mother alloy thus prepared was remelted in an argon atmosphere using quartz crucible, and held the temperature for 30 minutes, then injected from a nozzle on a Cu alloy roll having a diameter of 580 mm and rotated at 700 rpm. The melting temperature was 1,400° C., and the molten mother alloy was in an amount of 1 Kg. A single slot having a diameter of 0.6 mm was used as a nozzle. The results are shown in Table 7.

When a strip was obtained, the density of inclusions and the mechanical properties of the as cast strip were evaluated. The size and density of the inclusions were evaluated as follows: the inclusions were exposed on the surface of the strip by way of etching (the SPEED method), and many surface portions were microscopically observed with SEM and evaluated. The mechanical properties were evaluated by subjecting the as cast strip to a bending test as an angle of 180°. In addition, bending test samples of a lot were sampled at 1 m intervals from the as cast strip, and the number of samples was from 50 to 200. The results are shown in Table 7.

Furthermore, the ratio of the density of amorphous oxides to that of inclusions in a strip is also shown in Table 7. The ratio was evaluated by transferring inclusions to a carbon film from a microscopically observed face by the replica procedure, and evaluating with a TEM.

The strips No. 2 to No. 7 had no inclusions having a size of exceeding 50% of the strip thickness, and could be coiled without fracture. The strips No. 3 to No. 7 satisfied the mechanical properties of the present invention defined by $<\epsilon_f>$ and $\sigma$.

TABLE 7

| Strip No. | Oxygen concn. of mother alloy (ppm) | Density of nonmetallic inclusions (a number of nonmetallic inclusions/mm$^3$) 0.3–3 μm | 3–10 mm | 10-t/2 | Bending fracture strain $<\epsilon_f>$ | $\sigma/<\epsilon_f>$ (%) | Proportion of amorphous oxides (%) | |
|---|---|---|---|---|---|---|---|---|
| 1 | 450 | fractured at an inclusion having a size of at least t/2 (30 μm) | | | | | | C. Ex. |
| 2 | 350 | $6.4 \times 10^6$ | $3 \times 10^4$ | 20 | 0.028 | 60 | 15 | C. Ex. |
| 3 | 90 | $4 \times 10^5$ | $1 \times 10^3$ | 8 | 0.81 | 38 | 30 | P.I. |
| 4 | 70 | $3 \times 10^5$ | $5 \times 10^3$ | 6 | 0.90 | 35 | 40 | P.I. |
| 5 | 60 | $3 \times 10^5$ | $1.2 \times 10^3$ | 3 | 0.95 | 35 | 45 | P.I. |
| 6 | 40 | $9 \times 10^4$ | $9 \times 10^2$ | — | 0.98 | 10 | 55 | P.I. |
| 7 | 30 | $5 \times 10^4$ | $9 \times 10^2$ | — | 1.0 | 0 | 65 | P.I. |

Note: concn. = Concentration C. Ex. = Comparative Example, P.I. = Present Invention A rapidly quenched metal strip excellent in mechanical properties and showing decreased variations therein can be provided by using the rapidly quenched metal strip of the present invention inclusions of which are controlled. Moreover, since low cost raw materials can be used for the strip, effects of cutting the costs can be expected. Furthermore, a rapidly quenched metal strip showing excellent mechanical properties even after annealing can be provided by further decreasing the inclusions.

We claim:

1. An Fe-based rapidly quenched metal strip having a strip thickness exceeding 20 μm and up to 70 μm, wherein nonmetallic inclusions contained in said metal strip have a maximum particle size up to 50% of the strip thickness, and densities of the nonmetallic inclusions are up to 10 nonmetallic inclusions/mm$^3$ for nonmetallic inclusions having a particle size exceeding 10 μm and up to 50% of the strip thickness, up to $3\times10^3$ nonmetallic inclusions/mm$^3$ for nonmetallic inclusions having a particle size of at least 3 μm to up to 10 μm, and up to $5\times10^5$ nonmetallic inclusions/mm$^3$ for nonmetallic inclusions having a particle size of at least 0.3 μm to less than 3 μm, and showing the following average value $<\epsilon_f>$ of a bending fracture strain $\epsilon_f$, being bent with the free surface of the strip placed outside:

$$<\epsilon_f>=0.8-1.0$$

and the standard deviation $\sigma$ of the bending fracture strain $\epsilon_f$ is up to 50% of $<\epsilon_f>$, wherein $\epsilon_f=t/(D-t)$, wherein t is the strip thickness (mm), and D is the bend diameter of the fractured strip (mm).

2. The Fe-based rapidly quenched metal strip according to claim 1, wherein the nonmetallic inclusions contained in said metal strip have a maximum particle size up to 10 μm, the densities of the nonmetallic inclusions are up to $3\times10^3$ nonmetallic inclusions/mm$^3$ for nonmetallic inclusions having a particle size of at least 3 μm to up to 10 μm and up to $5\times10^5$ nonmetallic inclusions/mm$^3$ for nonmetallic inclusions having a particle size of at least 0.3 μm to less than 3 μm, and said metal strip shows the following average value $<\epsilon_f>$ of a bending fracture strain $\epsilon_f$, being bent with the free surface of the strip placed outside:

$$<\epsilon_f>=0.8-1.0$$

and the standard deviation $\sigma$ of the bending fracture strain $\epsilon_f$ is up to 30% of $<\epsilon_f>$, wherein $\epsilon_f=t/(D-t)$, t is the strip thickness (mm), and D is the bend diameter of the fractured strip (mm).

3. An Fe-based rapidly quenched metal strip having a strip thickness of at least 10 μm and up to 20 μm, wherein nonmetallic inclusions contained in said metal strip have a maximum particle size up to 50% of the strip thickness, and densities of the nonmetallic inclusions are up to $3\times10^3$ nonmetallic inclusions/mm$^3$ for nonmetallic inclusions having a particle size of at least 3 μm to up to 10 μm, and up to $5\times10^5$ nonmetallic inclusions/mm$^3$ for nonmetallic inclusions having a particle size of at least 0.3 μm to less than 3 μm, and showing the following average value $<\epsilon_f>$ of a bending fracture strain $\epsilon_f$, being bent with the free surface of the strip placed outside:

$$<\epsilon_f>=0.8-1.0$$

and the standard deviation $\sigma$ of the bending fracture strain $\epsilon_f$ is up to 30% of $<\epsilon_f>$, wherein $\epsilon_f=t/(D-t)$, t is the strip thickness (mm), and D is the bend diameter of the fractured strip (mm).

4. The Fe-based rapidly quenched metal strip according to claim 1, wherein at least 20% in terms of number of the nonmetallic inclusions per unit volume present in the strip are amorphous oxides containing one or at least two elements selected from the group consisting of Fe, Al, Si, B, Cr, Ni, Mn, Mg, Ca, Cu, Sn and Zr, and said metal strip shows the following average value $<\epsilon_f>$ of a bending fracture strain $\epsilon_f$, being bent with the free surface of the strip placed outside:

$$<\epsilon_f>=0.8-1.0$$

and the standard deviation σ of the bending fracture strain $\epsilon_f$ is up to 40% of $<\epsilon_f>$.

5. The Fe-based rapidly quenched metal strip according to claim 2, wherein at least 20% in terms of number of the nonmetallic inclusions per unit volume present in the strip are amorphous oxides containing one or at least two elements selected from the group consisting of Fe, Al, Si, B, Cr, Ni, Mn, Mg, Ca, Cu, Sn and Zr, and said metal strip shows the following average value $<\epsilon_f>$ of a bending fracture strain $\epsilon_f$, being bent with the free surface of the strip placed outside:

$$<\epsilon_f>=0.8-1.0$$

and the standard deviation σ of the bending fracture strain $\epsilon_f$ is up to 20% of $<\epsilon_f>$.

6. The Fe-based rapidly quenched metal strip according to claim 3, wherein at least 20% in terms of number of the nonmetallic inclusions per unit volume present in the strip are amorphous oxides containing one or at least two elements selected from the group consisting of Fe, Al, Si, B, Cr, Ni, Mn, Mg, Ca, Cu, Sn and Zr, and said metal strip shows the following average value $<\epsilon_f>$ of a bending fracture strain $\epsilon_f$, being bent with the free surface of the strip placed outside:

$$<\epsilon_f>=0.8-1.0$$

and the standard deviation σ of the bending fracture strain $\epsilon_f$ is up to 20% of $<\epsilon_f>$.

7. An Fe-based rapidly quenched metal strip having a strip thickness of at least 10 μm and up to 70 μm, wherein nonmetallic inclusions contained in said metal strip have a maximum particle size up to 50% of the strip thickness and up to 10 μm, and densities of the nonmetallic inclusions are up to $1\times10^2$ nonmetallic inclusions/mm$^3$ for nonmetallic inclusions having a particle size of at least 3 μm and up to 10 μm and up to $1\times10^3$ nonmetallic inclusions/mm$^3$ for nonmetallic inclusions having a particle size of at least 0.3 μm to less than 3 μm, and showing subsequently to annealing the following average value $<\epsilon_f>$ of a bending fracture strain $\epsilon_f$, being bent with the free surface of the strip placed outside:

$$<\epsilon_f>=0.1$$

and the standard deviation σ of the bending fracture strain $\epsilon_f$ is up to 50% of $<\epsilon_f>$ wherein $\epsilon_f=t/(D-t)$, t is the strip thickness (mm), and D is the bend diameter of the fractured strip (mm).

8. The Fe-based rapidly quenched metal strip according to claim 7, wherein the densities of the nonmetallic inclusions are up to 10 nonmetallic inclusions/mm$^3$ for nonmetallic inclusions having a particle size of at least 3 μm to up to 10 μm and up to $1\times10^2$ nonmetallic inclusions/mm$^3$ for nonmetallic inclusions having a particle size of at least 0.3 μm to less than 3 μm, and said metal strip shows subsequently to annealing the following average value $<\epsilon_f>$ of a bending fracture strain $\epsilon_f$, being bent with the free surface of the strip placed outside:

$$<\epsilon_f>=0.8-1.0$$

and the standard deviation σ of the bending fracture strain $\epsilon_f$ is up to 50% of $<\epsilon_f>$.

9. The Fe-based rapidly quenched metal strip according to claim 7, wherein at least 20% in terms of number of the nonmetallic inclusions per unit volume present in the strip are amorphous oxides containing one or at least two elements selected from the group consisting of Fe, Al, Si, B, Cr, Ni, Mn, Mg, Ca, Cu, Sn and zr, and said metal strip shows subsequently to annealing the following average value $<\epsilon_f>$ of a bending fracture strain $\epsilon_f$, being bent with the free surface of the strip placed outside:

$$<\epsilon_f>0.1$$

and the standard deviation σ of the bending fracture strain $\epsilon_f$ is up to 40% of $<\epsilon_f>$.

10. The Fe-based rapidly quenched metal strip according to claim 8, wherein at least 20% in terms of number of the nonmetallic inclusions per unit volume present in the strip are amorphous oxides containing one or at least two elements selected from the group consisting of Fe, Al, Si, B, Cr, Ni, Mn, Mg, Ca, Cu, Sn and Zr, and said metal strip shows subsequently to annealing the following average value $<\epsilon_f>$ of a bending fracture strain $\epsilon_f$, being bent with the free surface of the strip placed outside:

$$<\epsilon_f>=0.8-1.0$$

and the standard deviation σ of the bending fracture strain $\epsilon_f$ is up to 40% of $<\epsilon_f>$.

* * * * *